US011802534B2

(12) United States Patent
Ohata

(10) Patent No.: US 11,802,534 B2
(45) Date of Patent: Oct. 31, 2023

(54) CONTROL DEVICE FOR INTERNAL COMBUSTION ENGINE

(71) Applicant: Hitachi Astemo, Ltd., Hitachinaka (JP)

(72) Inventor: Eiichirou Ohata, Hitachinaka (JP)

(73) Assignee: Hitachi Astemo, Ltd., Hitachinaka (JP)

( * ) Notice: Subject to any disclaimer, the term of this patent is extended or adjusted under 35 U.S.C. 154(b) by 73 days.

(21) Appl. No.: 17/595,680

(22) PCT Filed: Mar. 27, 2020

(86) PCT No.: PCT/JP2020/013951
§ 371 (c)(1),
(2) Date: Nov. 22, 2021

(87) PCT Pub. No.: WO2020/235219
PCT Pub. Date: Nov. 26, 2020

(65) Prior Publication Data

US 2022/0213857 A1 Jul. 7, 2022

(30) Foreign Application Priority Data

May 23, 2019 (JP) ..... 2019-097027

(51) Int. Cl.
*F02P 3/04* (2006.01)
*F02D 41/00* (2006.01)
(Continued)

(52) U.S. Cl.
CPC ..... *F02P 3/0414* (2013.01); *F02D 41/0047* (2013.01); *F02P 5/1516* (2013.01);
(Continued)

(58) Field of Classification Search
CPC ..... F02P 3/0414; F02P 5/1516; F02P 15/08; F02P 3/04; F02D 41/0047; F02D 37/02; F02D 41/005; F02D 41/34
See application file for complete search history.

(56) References Cited

U.S. PATENT DOCUMENTS

2014/0345565 A1* 11/2014 Mori ..... F02P 15/08 123/406.12
2016/0010616 A1* 1/2016 Kimura ..... F02D 35/021 123/146.5 R
(Continued)

FOREIGN PATENT DOCUMENTS

JP 2015-14237 A 1/2015
JP 2017-48713 A 3/2017
(Continued)

OTHER PUBLICATIONS

International Search Report (PCT/ISA/210) issued in PCT Application No. PCT/JP2020/013951 dated Jul. 21, 2020 with English translation (four (4) pages).

*Primary Examiner* — Logan M Kraft
*Assistant Examiner* — Susan E Scharpf
(74) *Attorney, Agent, or Firm* — Crowell & Moring LLP

(57) ABSTRACT

The present invention is provided to suppress the power consumption, the calorific value, and the volume of an ignition device in an internal combustion engine while suppressing failures in igniting fuel by an ignition plug. To achieve this, a control device 1 for the internal combustion engine includes an ignition control unit that controls energization of an ignition coil 300 that gives electric energy to an ignition plug 200 that discharges in a cylinder 150 of an internal combustion engine 100 to ignite fuel. The ignition control unit controls energization of the ignition coil 300 so that first electric energy is released from the ignition coil 300 while second electric energy is released as electric energy superposed on the first electric energy, the second electric energy changing based on a gas state around the ignition plug 200.

7 Claims, 10 Drawing Sheets

(51) Int. Cl.

| | |
|---|---|
| ***F02P 15/08*** | (2006.01) |
| ***F02P 5/15*** | (2006.01) |
| ***F02D 37/02*** | (2006.01) |
| ***F02D 41/34*** | (2006.01) |

(52) U.S. Cl.
CPC ..... *F02P 15/08* (2013.01); *F02D 37/02* (2013.01); *F02D 41/005* (2013.01); *F02D 41/34* (2013.01); *F02P 3/04* (2013.01)

(56) References Cited

U.S. PATENT DOCUMENTS

| | | | | |
|---|---|---|---|---|
| 2016/0084213 | A1* | 3/2016 | Nakayama | F02P 3/0407 123/634 |
| 2016/0102648 | A1* | 4/2016 | Nakayama | F02P 9/007 123/620 |
| 2017/0058854 | A1* | 3/2017 | Nakamura | F02P 5/152 |
| 2017/0114766 | A1* | 4/2017 | Fujimoto | H01F 38/12 |
| 2017/0159634 | A1* | 6/2017 | Fujimoto | F02D 41/0002 |
| 2018/0195485 | A1* | 7/2018 | Seimiya | F02P 17/12 |
| 2019/0040835 | A1* | 2/2019 | Tanaka | F02P 3/01 |

FOREIGN PATENT DOCUMENTS

| | | |
|---|---|---|
| WO | WO 2017/010310 A1 | 1/2017 |
| WO | WO 2018/131407 A1 | 7/2018 |

* cited by examiner

FIG. 5
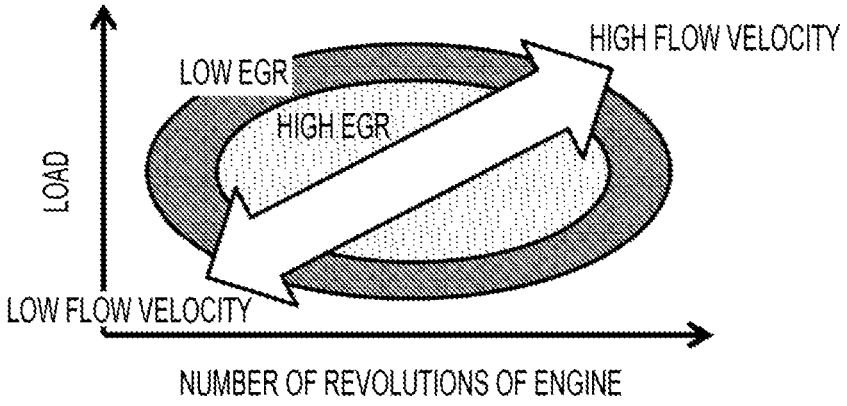
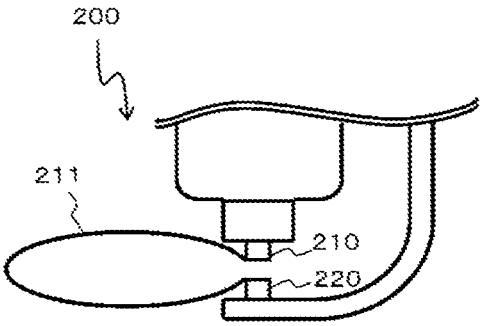
HIGH FLOW VELOCITY
FIG. 6A
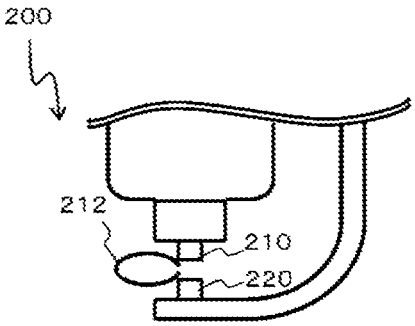
LOW FLOW VELOCITY
FIG. 6B

EXECUTING NO SUPERPOSING DISCHARGE

EXECUTING SUPERPOSING DISCHARGE

CONTROL DEVICE FOR INTERNAL COMBUSTION ENGINE

TECHNICAL FIELD

The present invention relates to a control device for an internal combustion engine.

BACKGROUND ART

In recent years, to improve the fuel efficiency of a vehicle, a control device for an internal combustion engine has been developed, the control device utilizing newly introduced techniques, such as a technique of operating the internal combustion engine by burning an air-fuel mixture thinner than an air-fuel mixture with a theoretical air-fuel ratio and a technique of recovering part of an exhaust gas resulting from combustion and introducing the exhaust gas into the air-fuel mixture again.

According to this type of control device for an internal combustion engine, the amount of fuel or air in a combustion chamber deviates from a theoretical value, and, consequently, a failure by an ignition plug in igniting the fuel is apt to occur. One method of solving this problem is to extend a discharge path generated between the electrodes of the ignition plug by increasing a discharge current of the ignition plug and suppress ignition failures by the extended discharge path. However, to increase the discharge current of the ignition plug, an ignition device increases the amount of charge/discharge. This leads to an increase in the calorific value or the volume of the ignition device.

Patent Literature 1 discloses a control device for an internal combustion engine according to which, by using two ignition coils, the number of ignition coils to be actuated is changed according to the likelihood of occurrence of an ignition failure under each operation condition.

CITATION LIST

Patent Literature

PLT 1: WO 2017/010310 A

SUMMARY OF INVENTION

Technical Problem

In general, a gas flow velocity in a cylinder increases as the number of revolutions of an engine and a filling factor increase. When the gas flow velocity is high, it is necessary that a longer discharge path be formed by outputting a large amount of power in a short time to increase opportunities for the gas and the discharge path to come in contact with each other. When the gas flow velocity is low, the discharge path cannot be made longer. It is necessary in this case that a small amount of power be outputted for a long time to form a shorter discharge path that lasts for a longer time, which increases opportunities for the gas and the discharge path to come in contact with each other. However, according to the technique disclosed in Patent Literature 1, because the likelihood of occurrence of an ignition failure needs to be reduced regardless of the flow velocity, a large amount of power is outputted for a long time. The calorific value and the volume of the ignition device, therefore, cannot be suppressed.

The present invention has been conceived in view of the above problems, and it is therefore an object of the invention to suppress the power consumption, the calorific value, and the volume of an ignition device in an internal combustion engine while suppressing failures in igniting fuel by an ignition plug.

Solution to Problem

A control device for an internal combustion engine according to the present invention includes an ignition control unit that controls energization of an ignition coil that gives electric energy to an ignition plug that discharges in a cylinder of the internal combustion engine to ignite fuel. The ignition control unit controls energization of the ignition coil so that first electric energy is released from the ignition coil while second electric energy is released as energy superposed on the first electric energy, the second electric energy changing based on a gas state around the ignition plug.

Advantageous Effects of Invention

According to the present invention, the power consumption, the calorific value, and the volume of an ignition device in an internal combustion engine can be suppressed as failures in igniting fuel by an ignition plug is suppressed.

BRIEF DESCRIPTION OF DRAWINGS

FIG. 5 is a diagram for explaining a relationship between an operating state of the internal combustion engine and a gas flow velocity around the ignition plug.

FIGS. 6A and 6B are diagrams for explaining a relationship between a discharge path and a flow velocity, the relationship being observed between electrodes of the ignition plug.

DESCRIPTION OF EMBODIMENTS

A control device for an internal combustion engine according to embodiments of the present invention will hereinafter be described.

Hereinafter, a control device 1, which is one mode of the control device for the internal combustion engine according to one embodiment of the present invention, will be described. In the present embodiment, a case where the control device 1 controls discharge (ignition) of an ignition plug 200 provided in each of cylinders 150 making up a four-cylinder internal combustion engine 100 will be described exemplarily.

Hereinafter, in the embodiment, a combination of some or all of constituent elements of the internal combustion engine 100 and some or all of constituent elements of the control device 1 will be generally referred to as the control device 1 of the internal combustion engine 100.

[Internal Combustion Engine]

Figure 1:
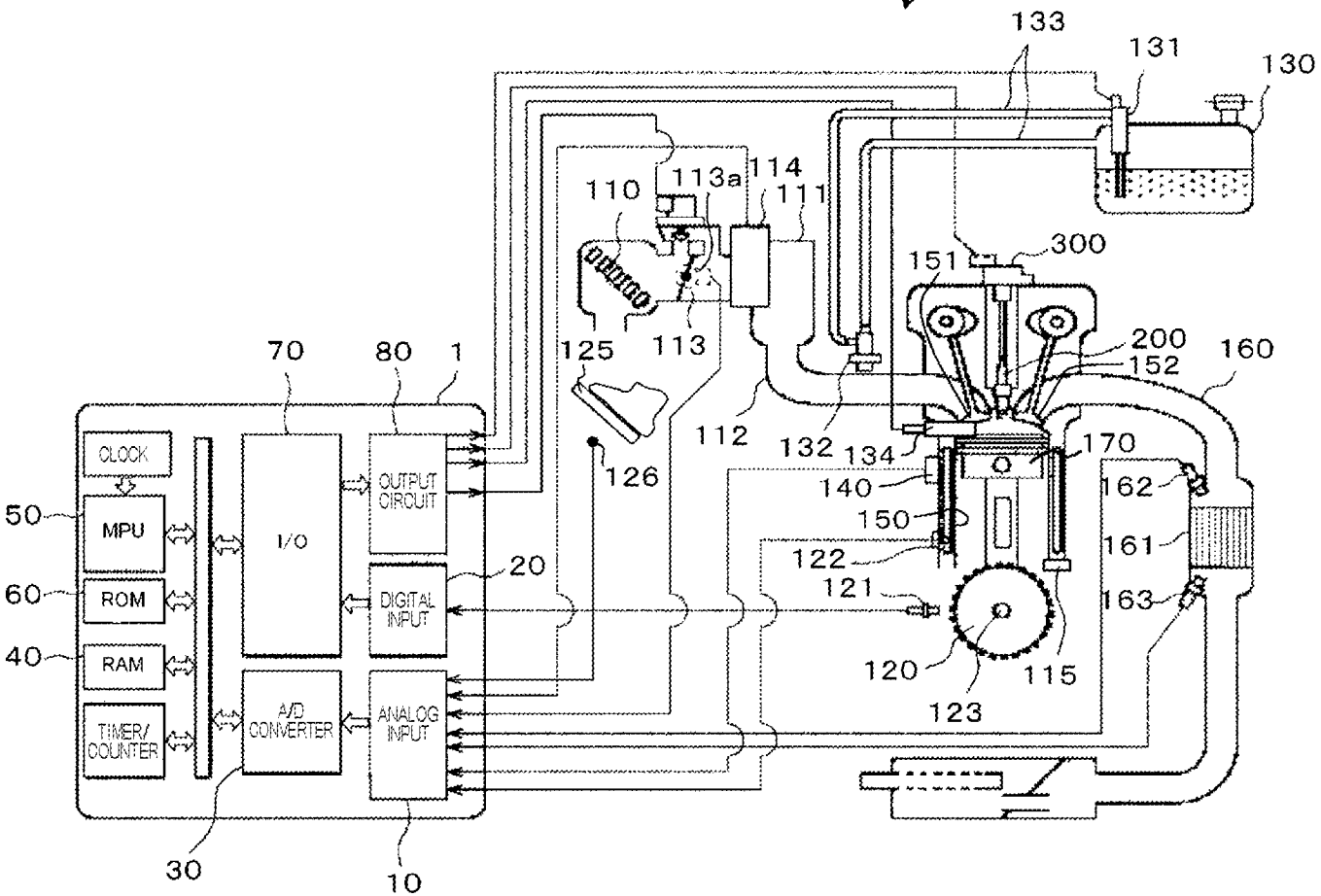
FIG. 1 is a diagram for explaining a configuration of a principle part of an internal combustion engine and a control device for the internal combustion engine according to an embodiment.

FIG. 1 is a diagram for explaining a configuration of a principle part of the internal combustion engine 100 and an ignition device for the internal combustion engine.

Figure 2:
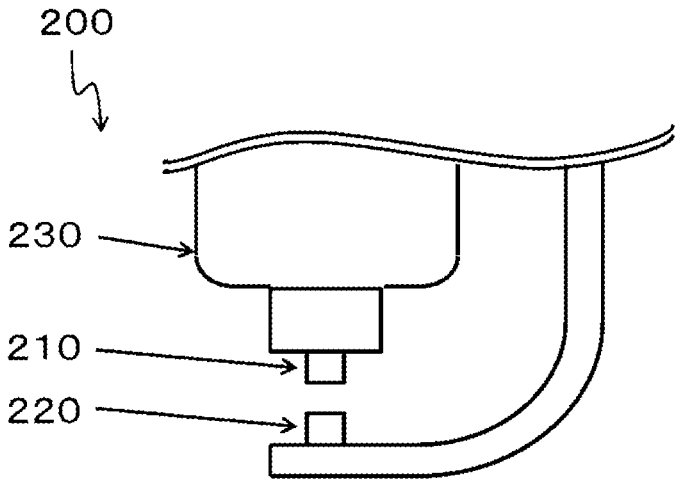
FIG. 2 is a partially enlarged view for explaining an ignition plug.

FIG. 2 is a partially enlarged view for explaining electrodes 210 and 220 of an ignition plug 200.

In the internal combustion engine 100, external air taken into the internal combustion engine 100 flows through an air cleaner 110, an air intake pipe 111, and an air intake manifold 112, and flows into each cylinder 150 when an air intake valve 151 opens. The amount of air flowing into each cylinder 150 is adjusted by a throttle valve 113, and the amount of air adjusted by the throttle valve 113 is measured by a flow sensor 114.

The throttle valve 113 is provided with a throttle opening sensor 113*a* that detects a degree of opening of a throttle. Information on the degree of opening of the throttle valve 113, the degree of opening being detected by the throttle opening sensor 113*a*, is outputted to the control device (electronic control unit or ECU) 1.

As the throttle valve 113, an electronic throttle valve driven by an electric motor is used. However, a different type of valve may also be used as the throttle valve 113, providing that it can adjust an air flow rate properly.

The temperature of a gas flowing into each cylinder 150 is detected by an intake air temperature sensor 115.

A crank angle sensor 121 is provided outside a ring gear 120 attached to a crankshaft 123 in such a way as to be on an extension of the radius of the ring gear 120. The crank angle sensor 121 detects a rotation angle of the crankshaft 123. In the embodiment, the crank angle sensor 121 detects the rotation angle of the crankshaft 123, for example, in every 10-degree shift and in every combustion cycle.

A water jacket (not illustrated) of a cylinder head is provided with a water temperature sensor 122. This water temperature sensor 122 detects the temperature of cooling water for the internal combustion engine 100.

The vehicle is equipped with an accelerator position sensor (APS) 126 that detects an amount of displacement of an accelerator pedal 125 (amount of stepping on the accelerator pedal 125). The accelerator position sensor 126 detects the driver's required torque. The driver's required torque detected by the accelerator position sensor 126 is outputted to the control device 1, which will be described later. The control device 1 controls the throttle valve 113, based on the required torque.

Fuel stored in a fuel tank 130 is sucked and pressurized by a fuel pump 131, flows through a fuel pipe 133 provided with a pressure regulator 132, and is led to a fuel injection valve (injector) 134. The fuel flowing out of the fuel pump 131 is adjusted in pressure by the pressure regulator 132 into the fuel with a given pressure, which is injected from the fuel injection valve (injector) 134 into each cylinder 150. As a result of the pressure adjustment by the pressure regulator 132, excess fuel is returned to the fuel tank 130 via a return pipe (not illustrated).

The cylinder head (not illustrated) of the internal combustion engine 100 is provided with a combustion pressure sensor (cylinder pressure sensor (CPS), which is also referred to as a cylinder internal pressure sensor) 140. The combustion pressure sensor 140 is disposed in each cylinder 150, and detects the internal pressure (combustion pressure) of the cylinder 150.

As the combustion pressure sensor 140, a piezoelectric-type or gauge-type pressure sensor is used. The combustion pressure sensor 140 is capable of detecting a combustion pressure (cylinder internal pressure) in the cylinder 150 over a wide temperature range.

Each cylinder 150 is fitted with an exhaust valve 152 and with an exhaust manifold 160 for discharging a gas (exhaust gas) resulting from combustion out of the cylinder 150. A three-way catalyst 161 is provided on the exhaust side of the exhaust manifold 160. When the exhaust valve 152 is opened, the exhaust gas is discharged from the cylinder 150 into the exhaust manifold 160. The exhaust gas flows through the exhaust manifold 160, is purified by the three-way catalyst 161, and then is discharged into the air.

An upstream side air-fuel ratio sensor 162 is provided on the upstream side of the three-way catalyst 161. The upstream side air-fuel ratio sensor 162 continuously detects the air-fuel ratio of the exhaust gas discharged from each cylinder 150.

A downstream side air-fuel ratio sensor 163 is provided on the downstream side of the three-way catalyst 161. The downstream side air-fuel ratio sensor 163 outputs a switch-like detection signal upon detecting an air-fuel ratio close to a theoretical air-fuel ratio. In the embodiment, the downstream side air-fuel ratio sensor 163 is provided as, for example, an 02 sensor.

The ignition plug 200 is provided above each cylinder 150. Discharge by the ignition plug 200 causes a spark (ignition), which ignites an air-fuel mixture in the cylinder 150, thus causing an explosion in the cylinder 150, and the explosion pushes a piston 170 down. The piston 170 being pushed down causes the crankshaft 123 to rotate.

The ignition plug 200 is connected to an ignition coil 300 that generates electric energy (voltage) supplied to the ignition plug 200. A voltage generated by the ignition coil 300 causes discharge between a center electrode 210 and an outer electrode 220 of the ignition plug 200 (see FIG. 2).

As shown in FIG. 2, in the ignition plug 200, the center electrode 210 is supported in an insulated state by an insulator 230. A prescribed voltage (e.g., 20,000V to 40,000V according to the embodiment) is applied to the center electrode 210.

The outer electrode 220 is grounded. When the prescribed voltage is applied to the center electrode 210, discharge (ignition) occurs between the center electrode 210 and the outer electrode 220.

It should be noted that in the ignition plug 200, a voltage that causes dielectric breakdown of a gas component to induce discharge (ignition) fluctuates, depending on a state of a gas present between the center electrode 210 and the outer electrode 220 or a cylinder internal pressure. This voltage that induces discharge is referred to as a dielectric breakdown voltage.

Discharge control (ignition control) over the ignition plug 200 is carried out by an ignition control unit 83 of the control device 1, which ignition control unit 83 will be described later.

FIG. 1 is referred to again. Output signals from various sensors mentioned above, such as the throttle opening sensor 113*a*, the flow sensor 114, the crank angle sensor 121, the accelerator position sensor 126, the water temperature sensor 122, and the combustion pressure sensor 140, are outputted to the control device 1. Based on the output signals from these various sensors, the control device 1 detects an operation state of the internal combustion engine 100, and controls an amount of air sent into the cylinder 150, an amount of fuel injection, and ignition timing of the ignition plug 200, and the like.

[Hardware Configuration of Control Device]

An overall hardware configuration of the control device 1 will then be described.

As shown in FIG. 1, the control device 1 includes an analog input unit 10, a digital input unit 20, an analog/digital (A/D) converter 30, a random access memory (RAM) 40, a micro-processing unit (MPU) 50, a read only memory (ROM) 60, an input/output (I/O) port 70, and an output circuit 80.

The analog input unit 10 receives incoming analog output signals from various sensors, such as the throttle opening sensor 113*a*, the flow sensor 114, the accelerator position sensor 126, the upstream side air-fuel ratio sensor 162, the downstream side air-fuel ratio sensor 163, the combustion pressure sensor 140, and the water temperature sensor 122.

To the analog input unit 10, the A/D converter 30 is connected. Analog output signals from various sensors inputted to the analog input unit 10 are subjected to signal processing, such as noise removal, are converted into digital signals by the A/D converter 30, and are stored in the RAM 40.

To the digital input unit 20, a digital output signal from the crank angle sensor 121 is inputted.

The digital input unit 20 is connected to the I/O port 70, and the digital output signal inputted to the digital input unit 20 is stored in the RAM 40 via the I/O port 70.

Each output signal stored in the RAM 40 is arithmetically processed by the MPU 50.

The MPU 50 executes a control program (not illustrated) stored in the ROM 60, thereby arithmetically processing the output signal stored in the RAM 40 according to the control program. According to the control program, the MPU 50 calculates a control value that defines an operation amount of each actuator (e.g., the throttle valve 113, the pressure regulator 132, the ignition plug 200, and the like) that drives the internal combustion engine 100, and temporarily stores the control value in the RAM 40.

The control value that defines the operation amount of the actuator, the control value being stored in the RAM 40, is outputted to the output circuit 80 via the I/O port 70.

The output circuit 80 includes a function of the ignition control unit 83 (see FIG. 3) that controls a voltage applied to the ignition plug 200.

[Functional Block of Control Device]

A functional configuration of the control device 1 according to the embodiment of the present invention will then be described.

Figure 3:
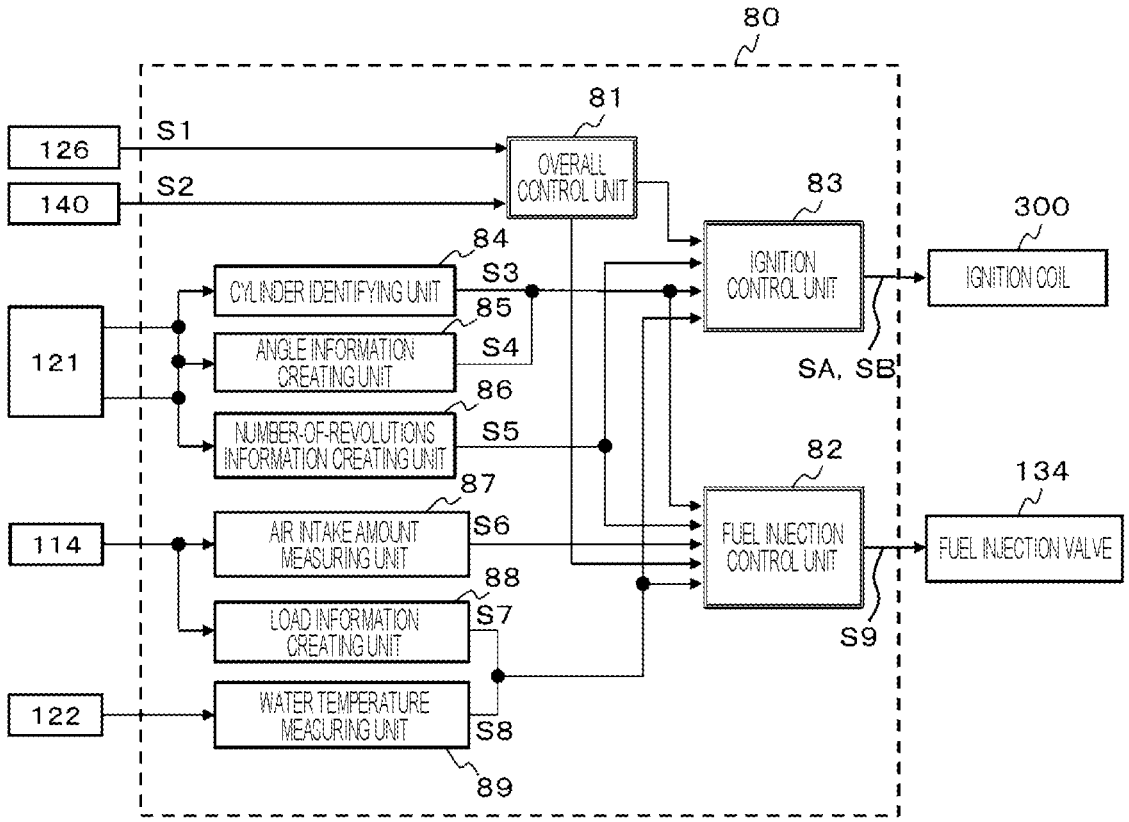
FIG. 3 is a functional block diagram for explaining a functional configuration of the control device according to the embodiment.

FIG. 3 is a functional block diagram for explaining a functional configuration of the control device 1 according to one embodiment of the present invention. Functions of the control device 1 are each implemented by the output circuit 80, for example, when the MPU 50 executes a control program stored in the ROM 60.

As shown in FIG. 3, the output circuit 80 of the control device 1 according to a first embodiment includes an overall control unit 81, a fuel injection control unit 82, and an ignition control unit 83.

The overall control unit 81 is connected to the accelerator position sensor 126 and to the combustion pressure sensor (CPS) 140, and receives a required torque (acceleration signal S1) from the accelerator position sensor 126 and an output signal S2 from the combustion pressure sensor 140.

Based on the required torque (acceleration signal S1) from the accelerator position sensor 126 and on the output signal S2 from the combustion pressure sensor 140, the overall control unit 81 carries out overall control of the fuel injection control unit 82 and the ignition control unit 83.

The fuel injection control unit 82 is connected to a cylinder identifying unit 84 that identifies each cylinder 150 of the internal combustion engine 100, to an angle information creating unit 85 that measures a crank angle of the crankshaft 123, and to a number-of-revolutions information creating unit 86 that measures the number of revolutions of the engine, and receives cylinder identifying information S3 from the cylinder identifying unit 84, crank angle information S4 from the angle information creating unit 85, and engine number-of-revolutions information S5 from the number-of-revolutions information creating unit 86.

The fuel injection control unit 82 is connected also to an air intake amount measuring unit 87 that measures an amount of air taken into the cylinder 150, to a load information creating unit 88 that measures an engine load, and to a water temperature measuring unit 89 that measures the temperature of engine cooling water, and receives air intake amount information S6 from the air intake amount measuring unit 87, engine load information S7 from the load information creating unit 88, and cooling water temperature information S8 from the water temperature measuring unit 89.

The fuel injection control unit 82 calculates an injection amount and an injection time (fuel injection valve control information S9) of the fuel injected from the fuel injection valve 134, based on each piece of information received, and controls the fuel injection valve 134, based on the calculated injection amount and injection time of the fuel.

The ignition control unit 83 is connected to the overall control unit 81 and to the cylinder identifying unit 84, the angle information creating unit 85, the number-of-revolutions information creating unit 86, the load information creating unit 88, and the water temperature measuring unit 89 as well, and receives pieces of information from these units.

Based on pieces of information received, the ignition control unit 83 calculates an amount of current supplied to a primary coil (not illustrated) of the ignition coil 300 (energization angle), an energization start time, and an energization end time at which current supply to the primary coil is cut off. The ignition coil 300 of the present embodiment has two types of primary coils, which will be described later. The ignition control unit 83, therefore, calculates the energization angle, the energization start time, and the energization end time of each of these two types of primary coils.

Based on the calculated energization angle, energization start time, and energization end time, the ignition control unit outputs an ignition signal SA and an ignition signal SB respectively to the two primary coils of the ignition coil 300, thereby carrying out discharge control (ignition control) of controlling discharge by the ignition plug 200.

The function of the ignition control unit 83 of carrying out ignition control over the ignition plug 200 using the ignition signals SA and SB at least corresponds to the control device for the internal combustion engine according to the present invention.

[Electric Circuit for Ignition Coil]

An electric circuit 400 including the ignition coil 300 according to the embodiment of the present invention will then be described.

Figure 4:
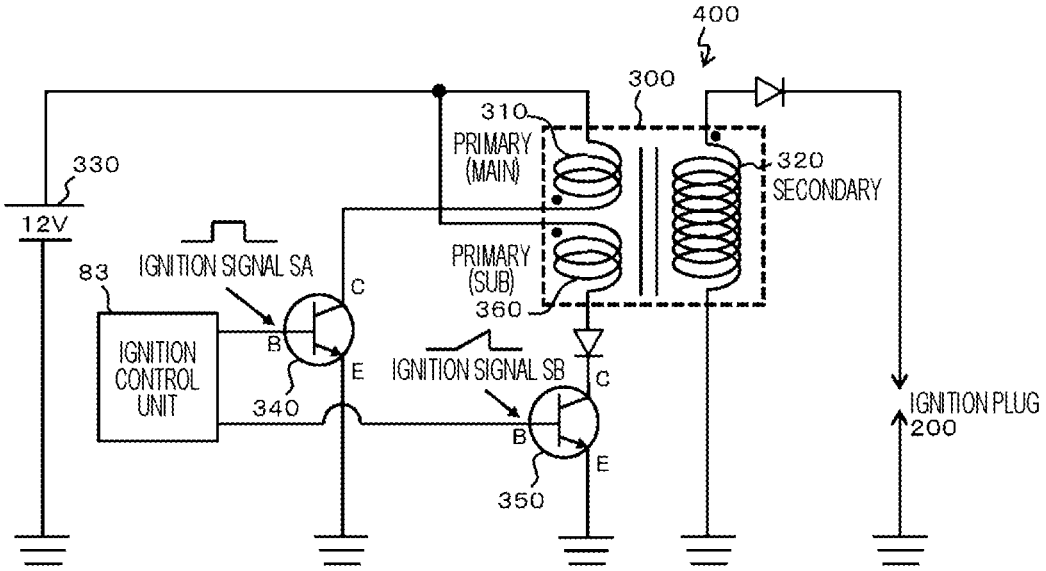
FIG. 4 is a diagram for explaining an electric circuit including the ignition coil according to the embodiment.

FIG. 4 is a diagram for explaining the electric circuit 400 including the ignition coil 300 according to one embodiment of the present invention. In the electric circuit 400, the ignition coil 300 includes two types of primary coils, i.e., primary coils 310 and 360 each having a winding tuned a given number of times, and a secondary coil 320 having a winding turned a number of times greater than the number of times the winding of each of the primary coils 310 and 360 is turned. Now, at the time of ignition by the ignition plug 200, power from the primary coil 310 is first supplied to the secondary coil 320, and then power from the primary coil 360 is supplied to the secondary coil 320, as power superposed on the power from the primary coil 310.

Hereinafter, in view of this process, the primary coil 310 will be referred to as a "primary main coil", and the primary coil 360 will be referred to as a "primary sub-coil". In addition, a current flowing through the primary main coil 310 will be referred to as "primary main current", and a current flowing through the primary sub-coil 360 will be referred to as "primary sub-current".

One end of the primary main coil 310 is connected to a DC power supply 330. Hence a given voltage (according to the embodiment, for example, 12V) is applied to the primary main coil 310.

The other end of the primary main coil 310 is connected to an igniter 340, and is grounded via the igniter 340. The igniter 340 is provided as a transistor, a field effect transistor (FET), or the like.

A base (B) terminal of the igniter 340 is connected to the ignition control unit 83. The ignition signal SA outputted from the ignition control unit 83 is inputted to the base (B) terminal of the igniter 340. The ignition signal SA inputted to the base (B) terminal of the igniter 340 puts a collector (C) terminal and an emitter (E) terminal of the igniter 340 in a conductive state to each other, thus causing a current flow between the collector (C) terminal and the emitter (E) terminal. As a result, the ignition signal SA outputted from the ignition control unit 83 flows to the primary main coil 310 of the ignition coil 300 via the igniter 340, which causes a primary main current to flow through the primary main coil 310, where power (electric energy) is accumulated.

When outputting the ignition signal SA from the ignition control unit 83 ceases to cut off the primary main current flow in the primary main coil 310, a high voltage is generated at the secondary coil 320, the high voltage corresponding to a ratio of the number of turns of the secondary coil 320 to the number of turns of the primary main coil 310.

One end of the primary sub-coil 360 is connected to the DC power supply 330 through a common node to which one end of the primary main coil 310 is connected. Thus, the given voltage (according to the embodiment, for example, 12V) is applied also to the primary sub-coil 360.

The other end of the primary sub-coil 360 is connected to an igniter 350 and is grounded via the igniter 350. The igniter 350 is provided as a transistor, a field effect transistor (FET), or the like.

A base (B) terminal of the igniter 350 is connected to the ignition control unit 83. The ignition signal SB outputted from the ignition control unit 83 is inputted to the base (B) terminal of the igniter 350. The ignition signal SB inputted to the base (B) terminal of the igniter 350 puts a collector (C) terminal and an emitter (E) terminal of the igniter 350 in a conductive state to each other, the conductive state corresponding to a change in voltage of the ignition signal SB, thus causing a current to flow between the collector (C) terminal and the emitter (E) terminal, the current corresponding to the change in voltage of the ignition signal SB. As a result, the ignition signal SB outputted from the ignition control unit 83 flows to the primary sub-coil 360 of the ignition coil 300 via the igniter 350, which causes a primary sub-current to flow through the primary sub-coil 360, where power (electric energy) is generated.

When output of the ignition signal SB from the ignition control unit 83 changes to cause a change in the primary sub-current flowing through the primary sub-coil 360, a high voltage is generated at the secondary coil 320, the high voltage corresponding to a ratio of the number of turns of the secondary coil 320 to the number of turns of the primary sub-coil 360.

The high voltage generated at the secondary coil 320 by the ignition signal SB is added to the high voltage generated at the secondary coil 320 by the ignition signal SA, and the sum of both high voltages is applied to the ignition plug 200 (the center electrode 210). This creates a potential difference between the center electrode 210 and the outer electrode 220 of the ignition plug 200. When the potential difference created between the center electrode 210 and the outer electrode 220 becomes equal to or larger than a dielectric breakdown voltage Vm for the gas (air-fuel mixture in the cylinder 150), the dielectric strength of the gas component breaks down, causing discharge between the center electrode 210 and the outer electrode 220, which ignites the fuel (air-fuel mixture).

Through the operation of the electric circuit 400 as described above, the ignition control unit 83 controls energization of the ignition coil 300, using the ignition signals SA and SB. Through this energization control, the ignition control unit 83 carries out ignition control of controlling the ignition plug 200.

[Controlling Energization of Ignition Coil]

Controlling energization of the ignition coil 300 according to one embodiment of the present invention will then be described. The ignition control unit 83 outputs the ignition signal SA and the ignition signal SB respectively to the igniter 340 and the igniter 350, thereby controlling energization of the primary main coil 310 and the primary sub-coil 360. In this energization control, a gas state around the ignition plug 200 in the cylinder 150 is estimated, and based on the estimated gas state, energization of the primary main coil 310 and the primary sub-coil 360 is controlled so that electric energy is released from the primary main coil 310 to the secondary coil 320 while electric energy is released from the primary sub-coil 360 to the secondary coil 320, as electric energy superposed on the electric energy released from the primary main coil 310. This energization control (which will hereinafter be referred to as superposing discharge control) by the ignition control unit 83 will hereinafter be described.

FIG. 5 is a diagram for explaining a relationship between an operating state of the internal combustion engine 100 and a gas flow velocity around the ignition plug 200. As shown in FIG. 5, in general, as the number of revolutions of the engine and load current get higher, a gas flow velocity in the cylinder 150 gets higher and therefore a gas flow velocity around the ignition plug 200 too gets higher. Thus, the gas flows at high speed between the center electrode 210 and the outer electrode 220 of the ignition plug 200. In the internal combustion engine 100 in which exhaust gas recirculation (EGR) is performed, an EGR rate is set according to a relationship between the number of revolutions of the engine and the load, for example, in a manner as shown in FIG. 5. Expanding a high EGR area, in which the EGR rate is set higher, achieves low fuel consumption and less exhaust gas but leads to more frequent ignition failures by the ignition plug 200.

FIG. 6 is a diagram for explaining a relationship between a discharge path and a flow velocity, the relationship being observed between the electrodes of the ignition plug 200.

When a high voltage is generated in the secondary coil 320 of the ignition coil 300 and dielectric breakdown occurs between the center electrode 210 and the outer electrode 220 of the ignition plug 200, a discharge path is formed and remains between the electrodes of the ignition plug 200 until a current flowing between these electrodes becomes equal to or less than a certain value. When the combustible gas comes in contact with the discharge path, a flame core grows and develops into combustion. Because the discharge path moves under the influence of a gas flow between the electrodes, a higher gas flow velocity results in formation of a longer discharge path in a shorter time while a lower gas flow velocity results in formation of a shorter discharge path. FIG. 6(*a*) shows an example of a discharge path 211 that is formed when the gas flow velocity is high, and FIG. 6(*b*) shows an example of a discharge path 212 that is formed when the gas flow velocity is low.

When the internal combustion engine 100 is operated at a high EGR rate, the probability that the flame core grows as a result of the combustible gases' coming into contact with the discharge path becomes lower. In this case, therefore, an opportunity for the combustible gas to come in contact with the discharge path needs to be increased. Because the discharge path is generated by breaking the dielectric strength of the gas, as described above, if the current necessary for maintaining the discharge path is constant, power output corresponding to the length of the discharge path is required. When the gas flow velocity is high, therefore, it is preferable that energization of the ignition coil 300 be controlled in such a way as to allow the ignition coil 300 to output large power to the ignition plug 200 in a short time, and that as a result of such energization control, the long discharge path 211 shown in FIG. 6(*a*) be formed to give the discharge path an opportunity to come in contact with the gas in a wider space. When the gas flow velocity is low, on the other hand, it is preferable that energization of the ignition coil 300 be controlled in such a way as to cause the ignition coil 300 to keep outputting small power to the ignition plug 200 for a long time, and that as a result of such energization control, the short discharge path 212 shown in FIG. 6(*b*) be maintained to give the discharge path an opportunity to come in contact with the gas flowing near the electrodes of the ignition plug 200 for a long time.

According to the present embodiment, the ignition coil 300 including the primary main coil 310 and the primary sub-coil 360, which have been described with reference to FIG. 4, is adopted, and superposing discharge control using the ignition signals SA and SB is carried out on the ignition coil 300 to allow the ignition plug 200 to perform the above-described discharge process.

Figure 7A:
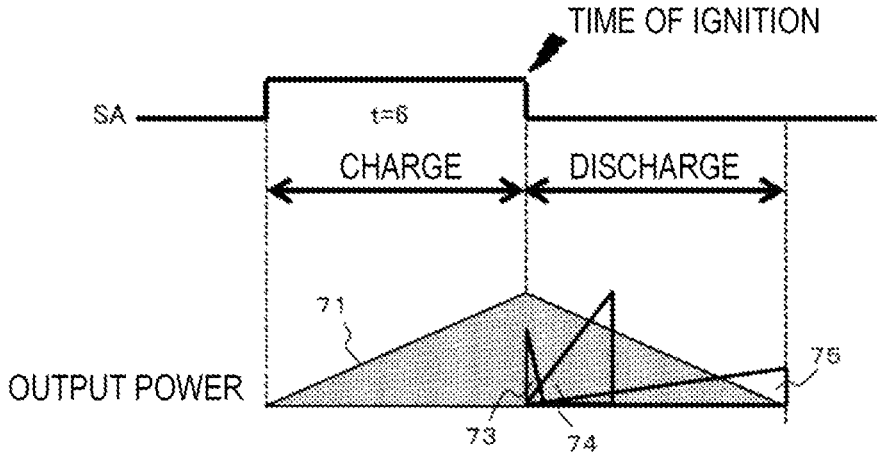
FIGS. 7A and 7B are diagrams for explaining a change in output power from the ignition coil, the change being caused by execution or non-execution of superposing discharge.
Figure 7B:
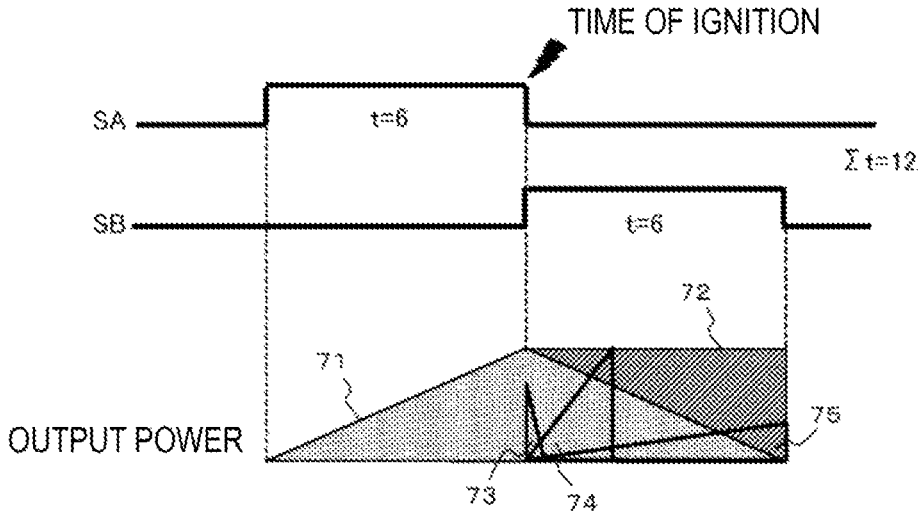

FIG. 7 is a diagram for explaining a change in output power from the ignition coil 300, the change being caused by execution or non-execution of superposing discharge. FIG. 7(*a*) shows a relationship between the output waveform of the ignition signal SA, output power from the ignition coil 300, and power required for gas combustion in a case of executing no superposing discharge, and FIG. 7 (*b*) shows a relationship between the output waveforms of the ignition signals SA and SB, output power from the ignition coil 300, and power required for gas combustion in a case of executing superposing discharge.

As described above, while the ignition control unit 83 keeps outputting the ignition signal SA, the primary main coil 310 accumulates electric energy. As a result, as shown in FIGS. 7(*a*) and 7(*b*), output power 71 from the primary main coil 310 of the ignition coil 300 gradually increases. At this time, the primary main current flows in the primary main coil 310 because of a constant voltage supplied from the power supply, and heat is generated in an amount corresponding to a time the current keeps flowing. When output of the ignition signal SA ends, the electric energy having been accumulated in the primary main coil 310 is released, which starts power supply to the ignition plug 200 via the secondary coil 320. As a result, as shown in FIGS. 7 (*a*) and 7(*b*), the output power 71 from the primary main coil 310 decreases as the amount of electric energy in the primary main coil 310 decreases.

In the case of executing superposing discharge, on the other hand, the following process results. While the ignition control unit 83 keeps outputting the ignition signal SB, the primary sub-coil 360 releases electric energy corresponding in size to the primary sub-current flowing through the primary sub-coil 360, thus supplying power to the ignition plug 200 via the secondary coil 320. As a result, as shown in FIG. 7(*b*), the output power 71 from the primary main coil 310 and output power 72 from the primary sub-coil 360 of the ignition coil 300 are superposed together, and the sum of these output power is supplied to the ignition plug 200.

To allow discharge by the ignition plug 200 to cause gas combustion, two kinds of power, i.e., power for dielectric breakdown and power for maintaining the discharge path are basically required. The power required for maintaining the discharge path, as described above, varies depending on the gas flow velocity between the electrodes, and large power supplied for a short time is needed when the gas flow velocity is high, while small power supplied for a long time is needed when the gas flow velocity is low. In FIGS. 7(*a*) and 7(*b*), a FIG. 73 represents power for dielectric breakdown, a FIG. 74 represents power required for maintaining the discharge path when the gas flow velocity is high, and a FIG. 75 represents power required for maintaining the discharge path when the gas flow velocity is low.

In the example shown in FIG. 7(*a*), the FIGS. 74 and 75 both stick out from a figure representing the output power 71. This demonstrates a fact that required power is not supplied in both cases of high flow velocity and low flow velocity. Consequently, the ignition plug 200 cannot maintain the discharge path during its discharge process, in which case the discharge path short-circuits. As a result, the distance and the maintaining time of the discharge path becomes insufficient, which leads to a shortage of opportunities for the discharge path and the gas to come in contact with each other, thus causing a failure in gas combustion. To solve this problem only by the output power 71 from the primary main coil 310, the primary main coil 310 of a large size is needed because a sufficient amount of electric energy must be ensured. This, however, poses a problem that a charge time increases and, consequently, heat generation by the ignition coil 300 increases.

In the example shown in FIG. 7(*b*), on the other hand, the FIGS. 74 and 75 are both within an area representing the sum of the output power 71 and the output power 72. This demonstrates a fact that required power is supplied in both cases of high flow velocity and low flow velocity. In other words, by executing superposing discharge using two types of primary coils (the primary main coil 310 and the primary sub-coil 360), the occurrence of a combustion failure in the internal combustion engine 100 can be suppressed in both cases of high flow velocity and low flow velocity. Besides, because such superposing discharge can be made executable by merely adding a control board to the ignition coil 300, executing superposing discharge is more efficient in suppressing an increase in the volume of the ignition coil 300 than the case of increasing the amount of electric energy the primary main coil 310 is charged with.

However, in the example of FIG. 7(*b*), the output time of the ignition signal SA and of the ignition signal SB is t=6, and the sum of these signal output times is Σt=12. This is two times as large as the output time of the ignition signal SA shown in FIG. 7(*a*). In this manner, in superposing discharge depicted in FIG. 7(*b*), a difference between discharge power from the ignition coil 300 and power required for forming and maintaining the discharge path between the electrodes of the ignition plug 200 is large. As a result, power efficiency turns out to be low.

In the present embodiment, to improve power efficiency in superposing discharge, the ignition control unit 83 estimates a gas state around the ignition plug 200 in the cylinder 150, and changes the output time of the ignition signal SA and the output time and output timing of the ignition signal SB, based on the estimated gas state. As a result, energization of the ignition coil 300 is controlled so that electric energy accumulated by the primary main coil 310 is released from the ignition coil 300 while electric energy accumulated by the primary sub-coil 360, the electric energy changing based on a gas state around the ignition plug 200, is released as electric energy superposed on the electric energy accumulated by the primary main coil 310.

[First Superposing Discharge Control]

First superposing discharge control according to one embodiment of the present invention will then be described. In the first superposing discharge control, the output time and output timing of the ignition signal SB are changed in a manner described below, based on a gas flow velocity around the ignition plug 200.

Figure 8A:
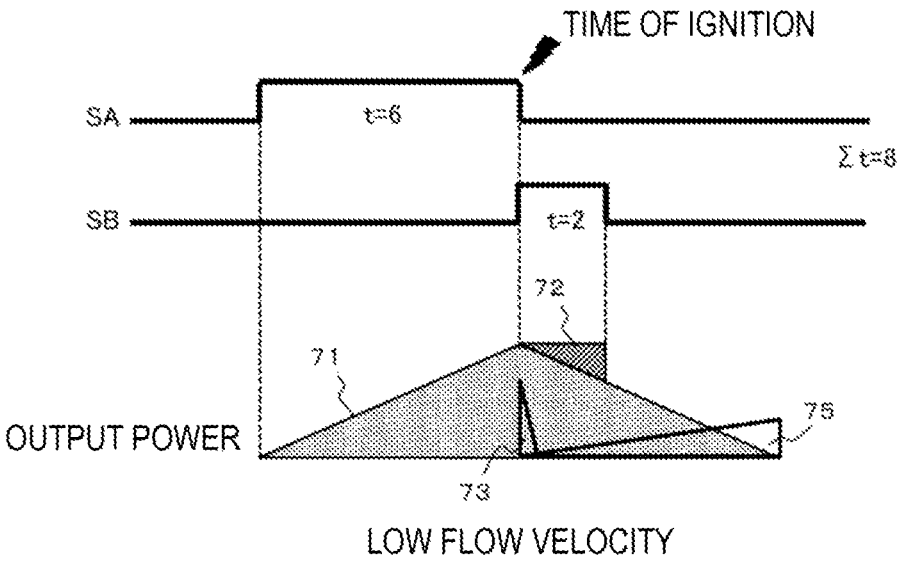
FIGS. 8A and 8B are diagrams for explaining first superposing discharge control.
Figure 8B:
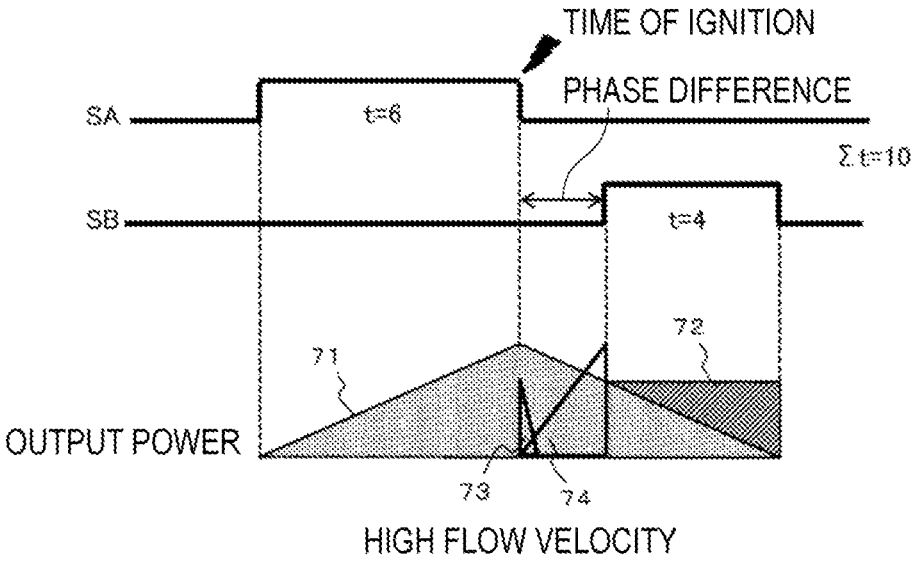

FIG. 8 is a diagram for explaining the first superposing discharge control. FIG. 8 (*a*) shows a relationship between the output waveforms of the ignition signals SA and SB, output power from the ignition coil 300, and power required for gas combustion in the low flow velocity case where the gas flow velocity is low, and FIG. 8 (*b*) shows a relationship between the output waveforms of the ignition signals SA and SB, output power from the ignition coil 300, and power required for gas combustion in the high flow velocity case where the gas flow velocity is high.

Generally, when the internal combustion engine 100 is operated at a low EGR rate, time of ignition is delayed because the phase of a combustion centroid needs to be corrected as a combustion speed increases. As a result of delaying the time of ignition, the volume of a combustion chamber at the time of ignition reduces, which makes the gas in the cylinder 150 the gas with a low flow velocity. In this case, therefore, the power for dielectric breakdown, which is represented by the FIG. 73, and the power required for maintaining the discharge path in the case of low flow velocity, which is represented by the FIG. 75, need to be supplied from the ignition coil 300 to the ignition plug 200, as shown in FIG. 8(*a*).

In the first superposing discharge control, the ignition signal SB is output following output of the ignition signal SA in the case of low flow velocity, as shown in FIG. 8(*a*). In this case, in comparison with the case of FIG. 7(*b*), the output time of the ignition signal SB is reduced to t=2, which gives a signal output time Σt=8, the signal output time being the sum of the output times of the ignition signals SA and SB. This improves power efficiency. In FIG. 8(*a*), however, a part of the FIG. 75 sticks out of the area representing the sum of the output power 71 and the output power 72. This means that the discharge path cannot be maintained for a necessary period in the case of low flow velocity, which raises a concern that a failure in gas combustion may occur.

When the internal combustion engine 100 is operated at a high EGR rate, in general, the time of ignition is advanced because the phase of the combustion centroid needs to be corrected as the combustion speed decreases. As a result of advancing the time of ignition, the volume of the combustion chamber at the time of ignition increases, which makes the gas in the cylinder 150 the gas with a high flow velocity. In this case, therefore, the power for dielectric breakdown, which is represented by the FIG. 73, and the power required for maintaining the discharge path in the case of high flow velocity, which is represented by the FIG. 74, need to be supplied from the ignition coil 300 to the ignition plug 200, as shown in FIG. 8(*b*).

According to the first superposing discharge control, in the case of high flow velocity, a phase difference is set between the ignition signal SA and the ignition signal SB, and the ignition signal SB is output at a point of time delayed from the end of output of the ignition signal SA by a time span equivalent to the phase difference, as shown in FIG. 8(*b*). At this time, the output time of the ignition signal SB in the case of FIG. 7(*b*) is reduced by the time span equivalent to the phase difference, to t=4. This improves power efficiency. In FIG. 8(*b*), however, a part of the FIG. 74 sticks out of the area representing the sum of the output power 71 and the output power 72. This means that a long discharge path cannot be formed in the case of high flow velocity, which raises a concern that a failure in gas combustion may occur. In addition, the signal output time that is the sum of the output times of the ignition signal SA and the ignition signal SB is Σt=10, which is larger than the signal output time Σt=8 shown in FIG. 8(*a*).

As described above, in the first superposing discharge control, power efficiency can be improved when the gas flow velocity is low, but the sufficient discharge path cannot be formed in both cases of low flow velocity and high flow velocity. In addition, a difference in the gas flow velocity results in a difference in the signal output time that is the sum of the output times of the ignition signal SA and the ignition signal SB. As a result, due to design-related considerations, a measure against heat generation by the ignition coil 300 needs to be taken in accordance with a condition under which the longer signal output time results. This leads to lower hardware efficiency.

[Second Superposing Discharge Control]

Second superposing discharge control according to one embodiment of the present invention will then be described. In the second superposing discharge control, the output time of the ignition signal SA and the output time and output timing of the ignition signal SB are changed in a manner described below, based on a gas flow velocity around the ignition plug 200.

Figure 9A:
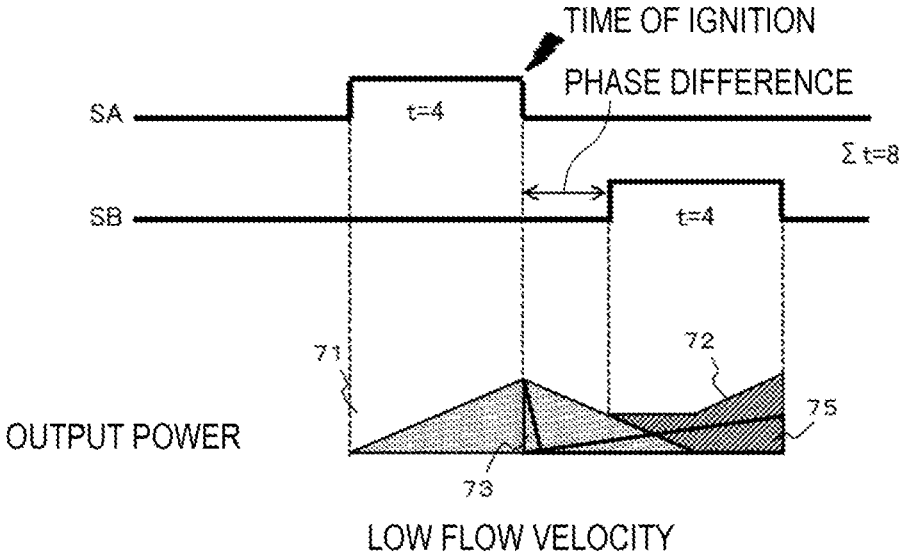
FIGS. 9A and 9B are diagrams for explaining second superposing discharge control.
Figure 9B:
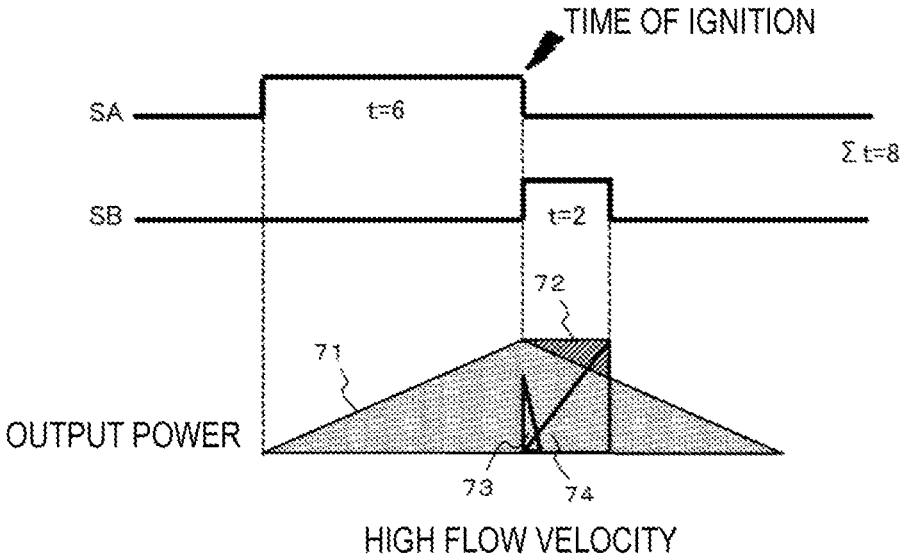

FIG. 9 is a diagram for explaining the second superposing discharge control. FIG. 9(*a*) shows a relationship between the output waveforms of the ignition signals SA and SB, output power from the ignition coil 300, and power required for gas combustion in the low flow velocity case where the gas flow velocity is low, and FIG. 9(*b*) shows a relationship between the output waveforms of the ignition signals SA and SB, output power from the ignition coil 300, and power required for gas combustion in the high flow velocity case where the gas flow velocity is high.

According to the second superposing discharge control, in the case of low flow velocity, the output time of the ignition signal SA is reduced to t=4 as a phase difference is set between the ignition signal SA and the ignition signal SB, and the ignition signal SB is output at a point of time delayed from the end of output of the ignition signal SA by a time span equivalent to the phase difference, as shown in FIG. 9(*a*). At this time, the signal output time that is the sum of the output times of the ignition signal SA and the ignition signal SB is Σt=8. In FIG. 9(*a*), the FIGS. 73 and 75 are both within the area representing the sum of the output power 71 and output power 72. This indicates that the discharge path can be maintained for a necessary period in the case of low flow velocity.

In the case of high flow velocity, on the other hand, the output time of the ignition signal SA is set t=6 while the output time of the ignition signal SB is reduced to t=2, as shown in FIG. 9(*b*). Zero phase difference is set between the ignition signal SA and the ignition signal SB, so that the ignition signal SB is output right after output of the ignition signal SA. At this time, the signal output time that is the sum of the output times of the ignition signal SA and the ignition signal SB is Σt=8, which is the same as the signal output time in the case of low flow velocity. In FIG. 9(*b*), the FIGS. 73 and 74 are both within the area representing the sum of the output power 71 and output power 72. This indicates that a long discharge path can be formed in the case of high flow velocity.

As described above, according to the second superposing discharge control, the primary sub-current is controlled, by adjusting the output time and output timing of the ignition signal SB, so that as the gas flow velocity around the ignition plug 200 becomes higher, timing of the primary sub-current's flowing through the primary sub-coil 360 is made earlier while a period of the primary sub-current's flowing through the primary sub-coil 360 is made shorter. In addition, the primary main current is controlled, by adjusting the output time of the ignition signal SA, so that as the gas flow velocity around the ignition plug 200 becomes higher, a period of the primary main current's flowing through the primary main coil 310 is made longer. It is preferable in this case that the primary main current and the primary sub-current be controlled so that the period of the primary sub-current's flowing through the primary sub-coil 360 becomes equal to or shorter than the discharge period of the primary main coil 310. Hence, in both cases of low flow velocity and high flow velocity, a difference between discharge power from the ignition coil 300 and power required for forming and maintaining the discharge path between the electrodes of the ignition plug 200 is reduced, which allows formation of a sufficient discharge path while improving power efficiency.

Further, according to the second superposing discharge control, the primary main current and the primary sub-current are controlled so that even when the gas flow velocity changes, the signal output time given by summing up the output times of the ignition signal SA and the ignition signal SB, that is, the sum of the period of the primary main current's flowing through the primary main coil 310 and the period of the primary sub-current's flowing through the primary sub-coil 360 becomes constant. As a result, a measure against heat generation by the ignition coil 300 set under the same condition can be taken, regardless of the gas flow velocity. This improves hardware efficiency.

Figure 10A:
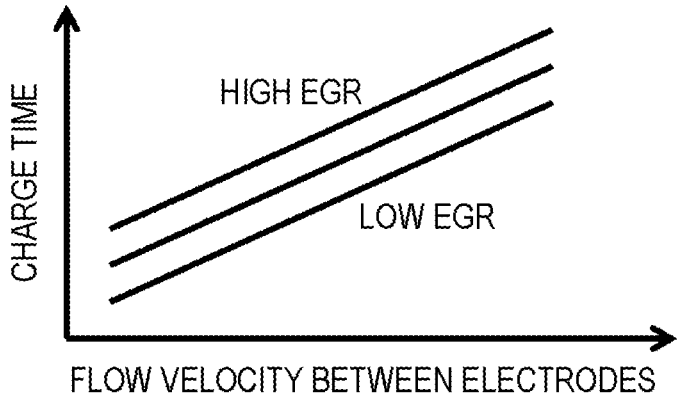
FIGS. 10A-10C are diagrams for explaining a relationship between a gas flow velocity between the electrodes and set values for ignition signals in the second superposing discharge control.
Figure 10B:
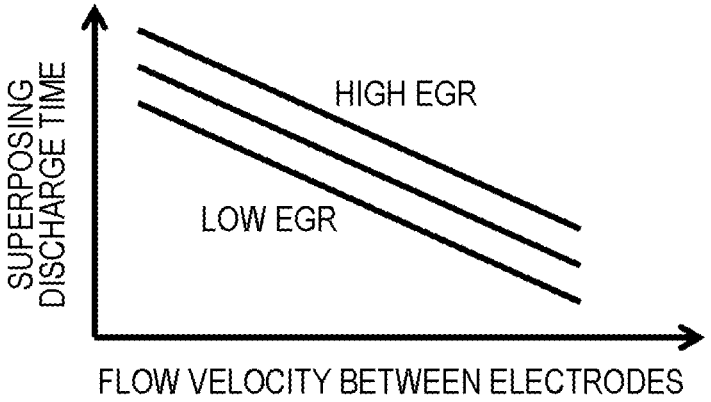
Figure 10C:
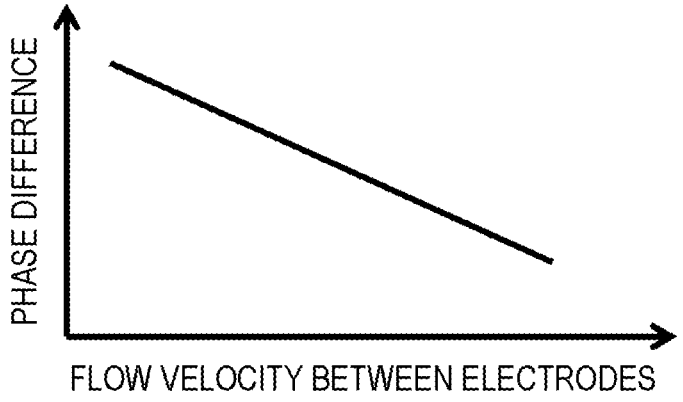

FIG. 10 is a diagram for explaining a relationship between a gas flow velocity between the electrodes and set values for the ignition signals SA and SB in the second superposing discharge control.

FIG. 10(*a*) shows a relationship between the gas flow velocity and a charge time of the primary main coil 310. As indicated in FIG. 10(*a*), the ignition control unit 83 sets the output time of the ignition signal SA so that the charge time of the primary main coil 310 becomes longer as the gas flow velocity between the electrodes becomes higher. In a case where the gas flow velocity remains the same, the output time of the ignition signal SA is set so that the charge time of the primary main coil 310 becomes longer as the EGR rate becomes higher.

FIG. 10(*b*) shows a relationship between the gas flow velocity and a superposing discharge time of the primary sub-coil 360. As indicated in FIG. 10(*b*), the ignition control unit 83 sets the output time of the ignition signal SB so that the superposing discharge time of the primary sub-coil 360 during discharge by the primary main coil 310 becomes shorter as the gas flow velocity between the electrodes becomes higher. In a case where the gas flow velocity remains the same, the output time of the ignition signal SB is set so that the superposing discharge time of the primary sub-coil 360 becomes longer as the EGR rate becomes higher.

FIG. 10(*c*) shows a relationship between the gas flow velocity and a phase difference between a discharge start time of the primary main coil 310 and a discharge start time of the primary sub-coil 360. As indicated in FIG. 10(*c*), the ignition control unit 83 sets output timing of the ignition signal SA and of the ignition signal SB so that as the gas flow velocity between the electrodes becomes higher, the phase difference between the discharge start time of the primary main coil 310 and the discharge start time of the primary sub-coil 360 becomes shorter and, consequently, timing of starting discharge by the primary sub-coil 360 becomes earlier.

As described above, by determining respective output times and output timing of the ignition signals SA and SB according to the gas flow velocity between the electrodes, power required for ignition, the power changing depending on the gas flow velocity between the electrodes, can be supplied as power with less excess or shortage, from the ignition coil 300 to the ignition plug 200.

It should be noted that in setting the ignition signals SA and SB according to the gas flow velocity between the electrodes under the second superposing discharge control, as described above, any given pattern of setting may be selectively carried out. For example, the ignition signal SB may be set so that the period of the primary sub-current's flowing through the primary sub-coil 360 is set constant and timing of the primary sub-current's flowing is made earlier as the gas flow velocity around the ignition plug 200 becomes higher. Alternatively, the ignition signal SB may be set so that timing of the primary sub-current's flowing through the primary sub-coil 360 is set constant and the period of the primary sub-current's flowing is made shorter as the gas flow velocity around the ignition plug 200 becomes higher. Through these approaches, power required for ignition, the power changing depending on the gas flow velocity between the electrodes, can be supplied as power adjusted within a certain range, from the ignition coil 300 to the ignition plug 200.

[Method for Controlling Ignition Coil]

Figure 11:
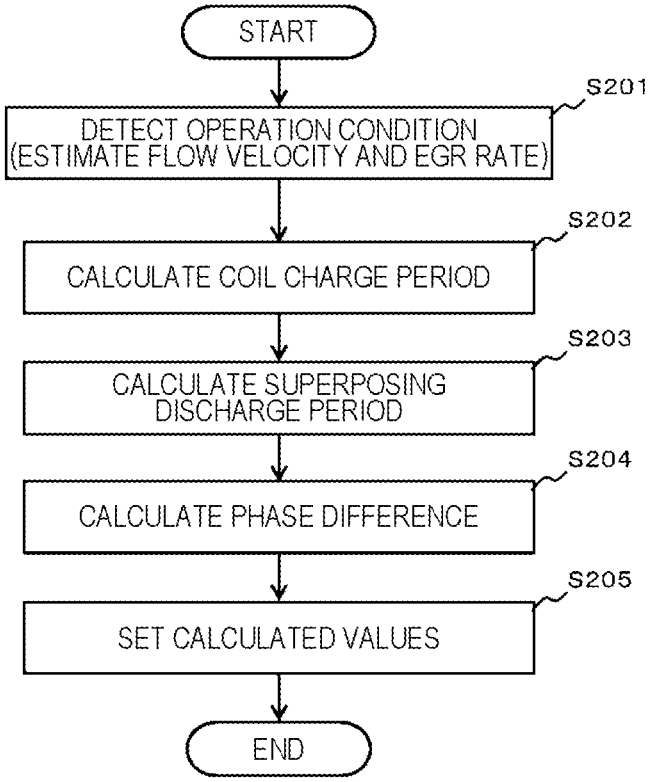
FIG. 11 is an example of a flowchart for explaining a method of controlling the ignition coil.

A method of controlling the ignition coil 300 by the ignition control unit 83 when the first and second superposing discharge controls are carried out will then be described. FIG. 11 is an example of a flowchart for explaining a method of controlling the ignition coil 300 by the ignition control unit 83 according to one embodiment of the present invention. In the present embodiment, when the ignition switch of the vehicle is turned on to supply power to the internal combustion engine 100, the ignition control unit 83 starts controlling the ignition coil 300 according to the flowchart of FIG. 11. It should be noted that steps shown in the flowchart of FIG. 11 represent steps for one cycle of the internal combustion engine 100, and that the ignition control unit 83 executes the steps shown in the flowchart of FIG. 11 for each cycle.

At step S201, the ignition control unit 83 detects an operation condition for the internal combustion engine 100, and estimates a flow velocity and an EGR rate of the gas. Specifically, for example, the ignition control unit 83 stores values for a gas flow velocity and an EGR rate that are determined in advance for each operation condition, as map information, and substitutes the detected number of revolutions of the engine and an estimated load in the map information, thereby obtaining values for a gas flow velocity and an EGR rate that correspond to a current operation state of the internal combustion engine 100.

At step S202, the ignition control unit 83 calculates a coil charging period. Specifically, for example, the ignition control unit 83 stores the relationship between the gas flow velocity and the charge time of the primary main coil 310, the relationship being shown in FIG. 10(*a*), as map information, and substitutes the flow velocity and the EGR rate obtained at step S201 in the map information, thereby obtaining a value for the charge time of the primary main coil 310.

At step S203, the ignition control unit 83 calculates a superposing discharge period. Specifically, for example, the ignition control unit 83 stores the relationship between the gas flow velocity and the superposing discharge time of the primary sub-coil 360, the relationship being shown in FIG. 10(*b*), as map information, and substitutes the flow velocity and the EGR rate obtained at step S201 in the map information, thereby obtaining a value for the superposing discharge time of the primary sub-coil 360.

At step S204, the ignition control unit 83 calculates a phase difference. Specifically, for example, the ignition control unit 83 stores the relationship between the gas flow velocity and the phase difference between the discharge start time of the primary main coil 310 and the discharge start time of the primary sub-coil 360, the relationship being shown in FIG. 10(*c*), as map information, and substitutes the flow velocity and the EGR rate obtained at step S201 in the map information, thereby obtaining a value for a phase difference between discharge by the primary main coil 310 and discharge by the primary sub-coil 360.

At step S205, the ignition control unit 83 sets calculated values. Specifically, the ignition control unit 83 stores respective values for the coil charge period, the superposing discharge period, and the phase difference, the values being calculated at steps S202 to S204, in a storage area of the ignition control unit 83, so that the ignition signals SA and SB reflecting these calculated values are output in the next and subsequent cycles of ignition control. After setting the calculated values at step S205, the ignition control unit 83 ends control of the ignition coil 300 that is executed according to the flowchart of FIG. 11.

The embodiment of the present invention described above offers the following effects.

(1) The control device 1 for the internal combustion engine includes the ignition control unit 83 that controls energization of an ignition coil 300 that gives electric energy to the ignition plug 200 that discharges in the cylinder 150 of the internal combustion engine 100 to ignite the fuel. The ignition control unit 83 controls energization of the ignition coil 300 so that first electric energy is released from the ignition coil 300 while second electric energy is released as electric energy superposed on the first electric energy, the second electric energy changing based on a gas state around the ignition plug 200. Hence the power consumption, the calorific value, and the volume of the ignition coil 300 in the internal combustion engine 100 can be suppressed as failures in igniting the fuel by the ignition plug 200 are suppressed.

(2) The ignition coil 300 has the primary main coil 310 and the primary sub-coil 360 that are disposed respectively on the primary side, and the secondary coil 320 disposed on the secondary side. The ignition control unit 83 controls the primary main current flowing through the primary main coil 310, and controls also the primary sub-current flowing through the primary sub-coil 360, based on the gas state around the ignition plug 200. Specifically, the ignition control unit 83 controls the primary sub-current so that as the gas flow velocity around the ignition plug 200 becomes higher, timing of the primary sub-current's flowing through the primary sub-coil 360 is made earlier and the period of the primary sub-current's flowing through the primary sub-coil 360 is made shorter. In addition, the ignition control unit 83 controls the primary main current so that as the gas flow velocity around the ignition plug 200 becomes higher, the period of the primary main current's flowing through the primary main coil 310 is made longer. Hence, in both cases of low flow velocity and high flow velocity, the difference between discharge power from the ignition coil 300 and power required for forming and maintaining the discharge path between the electrodes of the ignition plug 200 is reduced, which allows formation of a sufficient discharge path while improving power efficiency.

(3) The ignition control unit 83 controls the primary main current and the primary sub-current so that even if the gas flow velocity around the ignition plug 200 changes, the sum of the period of the primary main current's flowing through the primary main coil 310 and the period of the primary sub-current's flowing through the primary sub-coil 360 remains constant. As a result, a measure against heat generation by the ignition coil 300 set under the same condition can be taken, regardless of the gas flow velocity. This improves hardware efficiency.

(4) It is preferable that the ignition control unit 83 control the primary main current and the primary sub-current so that the period of the primary sub-current's flowing through the primary sub-coil 360 becomes equal to or shorter than the discharge period of the primary main coil 310. This limits the period in which the primary sub-coil 360 carries out superposing discharge to a period of a necessary length, thus allowing power saving.

(5) The ignition control unit 83 controls the primary main current and the primary sub-current so that as the EGR rate of the internal combustion engine 100 becomes higher, the period of the primary main current's flowing through the primary main coil 310 and the period of the primary sub-current's flowing through the primary sub-coil 360 are made longer. At this time, the primary sub-current is controlled so that even if the EGR rate of the internal combustion engine 100 changes, timing of the primary sub-current's flowing through the primary sub-coil 360 remains constant. Hence, in the internal combustion engine 100 in which exhaust gas recirculation is performed, optimum power according to the EGR rate can be supplied from the ignition coil 300 to the ignition plug 200.

In the embodiment described above, each of the functional components of the control device 1 described with reference to FIG. 3 may be provided, as stated above, in the form of software executed by the MPU 50 or in the form of hardware, such as a field-programmable gate array (FPGA). These software-based components and hardware-based components may be used in combination.

Embodiments and various modifications are described above as examples. Other modifications may be made providing that such modifications do not impair the features of the invention. These embodiments and modifications have been described herein, but the present invention is not limited to these embodiments and modifications. Other modes that can be conceived in the range of technical concept of the present invention are also included in the scope of the present invention.

REFERENCE SIGNS LIST

1 control device
10 analog input unit
20 digital input unit
30 A/D converter
40 RAM
50 MPU
60 ROM
70 I/O Port
80 output circuit
81 overall control unit
82 fuel injection control unit
83 ignition control unit
84 cylinder identifying unit
85 angle information creating unit
86 number-of-revolutions information creating unit
87 air intake amount measuring unit
88 load information creating unit
89 water temperature measuring unit
100 internal combustion engine
110 air cleaner
111 air intake pipe
112 air intake manifold
113 throttle valve
113*a* throttle opening sensor
114 flow sensor
115 intake air temperature sensor
120 ring gear
121 crank angle sensor
122 water temperature sensor
123 crankshaft
125 accelerator pedal
126 accelerator position sensor
130 fuel tank
131 fuel pump
132 pressure regulator
133 fuel pipe
134 fuel injection valve
140 combustion pressure sensor
150 cylinder
151 air intake valve
152 exhaust valve
160 exhaust manifold
161 three-way catalyst
162 upstream side air-fuel ratio sensor
163 downstream side air-fuel ratio sensor
170 piston
200 ignition plug
210 center electrode
220 outer electrode
230 insulator
300 ignition coil
310 primary main coil
320 secondary coil
330 DC power supply
340, 350 igniter
360 primary sub-coil
400 electric circuit

The invention claimed is:

1. A control device for an internal combustion engine, the control device comprising an ignition controller that controls energization of an ignition coil that gives electric energy to an ignition plug that discharges in a cylinder of the internal combustion engine to ignite fuel, wherein the ignition controller controls energization of the ignition coil so that first electric energy is released from the ignition coil while second electric energy is released as energy superposed on the first electric energy, the second electric energy changing based on a gas state around the ignition plug, wherein the ignition coil includes:

a primary main coil and a primary sub-coil that are disposed respectively on a primary side; and a secondary coil disposed on a secondary side, and the ignition controller controls a primary main current flowing through the primary main coil, and controls also a primary sub-current flowing through the primary sub-coil, based on the gas state around the ignition plug, and wherein the ignition controller controls the primary main current and the primary sub-current so that even if a gas flow velocity around the ignition plug changes, a sum of a period of the primary main current's flowing through the primary main coil and a period of the primary sub-current's flowing through the primary sub-coil remains constant.

2. The control device for the internal combustion engine according to claim 1, wherein the ignition controller controls the primary sub-current so that as a gas flow velocity around the ignition plug becomes higher, timing of the primary sub-current's flowing through the primary sub-coil is made earlier.

3. The control device for the internal combustion engine according to claim 1, wherein the ignition controller controls the primary sub-current so that as a gas flow velocity around the ignition plug becomes higher, a period of the primary sub-current's flowing through the primary sub-coil is made shorter.

4. The control device for the internal combustion engine according to claim 1, wherein the ignition controller controls the primary main current so that as a gas flow velocity around the ignition plug becomes higher, a period of the primary main current's flowing through the primary main coil is made longer.

5. The control device for the internal combustion engine according to claim 1, wherein the ignition controller controls the primary main current and the primary sub-current so that a period of the primary sub-current's flowing through the primary sub-coil becomes equal to or shorter than a discharge period of the primary main coil.

6. The control device for the internal combustion engine according to claim 1, wherein the ignition controller controls the primary main current and the primary sub-current so that as an EGR rate of the internal combustion engine becomes higher, a period of the primary main current's flowing through the primary main coil and a period of the primary sub-current's flowing through the primary sub-coil are made longer.

7. The control device for the internal combustion engine according to claim 1, wherein the ignition controller controls the primary sub-current so that even if an EGR rate of the internal combustion engine changes, timing of the primary sub-current's flowing through the primary sub-coil remains constant.

* * * * *